US006745658B2

(12) United States Patent
Betti et al.

(10) Patent No.: US 6,745,658 B2
(45) Date of Patent: Jun. 8, 2004

(54) SEVERING MACHINE FOR ARTICLES OF WEBLIKE MATERIAL HAVING A SHARPENING ZONE FOR THE BLADES SEPARATE FROM THE CUTTING ZONE

(75) Inventors: Giulio Betti, Lucca (IT); Angelo Benvenuti, Lucca (IT); Mario Gioni Chiocchetti, Lucca (IT)

(73) Assignee: Fabio Perini, S.p.A., Lucca (IT)

( * ) Notice: Subject to any disclaimer, the term of this patent is extended or adjusted under 35 U.S.C. 154(b) by 0 days.

(21) Appl. No.: 10/239,055

(22) PCT Filed: Mar. 23, 2001

(86) PCT No.: PCT/IT01/00143

§ 371 (c)(1),
(2), (4) Date: Sep. 19, 2002

(87) PCT Pub. No.: WO01/72484

PCT Pub. Date: Oct. 4, 2001

(65) Prior Publication Data

US 2003/0037653 A1 Feb. 27, 2003

(30) Foreign Application Priority Data

Mar. 28, 2000 (IT) ..... FI2000A0078

(51) Int. Cl.[7] ..... B26D 7/00; B26D 7/12

(52) U.S. Cl. ..... 83/411.6; 83/168; 83/174

(58) Field of Search ..... 83/411.3, 411.5, 83/411.6, 168, 174

(56) References Cited

U.S. PATENT DOCUMENTS

| | | | | | |
|---|---|---|---|---|---|
| 2,953,177 | A | * | 9/1960 | Galba | 83/411.6 |
| 3,122,043 | A | * | 2/1964 | Shanok et al. | 83/411.6 |
| 3,291,168 | A | * | 12/1966 | Zitner | 83/411.5 X |
| 3,757,622 | A | * | 9/1973 | Berry | 83/411.3 X |
| 3,797,338 | A | * | 3/1974 | Molnar | 83/411.6 X |
| 3,871,260 | A | * | 3/1975 | Rees | 83/174 X |
| RE30,598 | E | * | 5/1981 | Spencer | 83/174 X |
| 4,329,895 | A | | 5/1982 | Perini | |
| 4,651,790 | A | * | 3/1987 | Muller | 83/411.6 X |
| 4,813,319 | A | * | 3/1989 | Weyand, Jr. | 83/168 X |
| 5,435,217 | A | * | 7/1995 | Kato et al. | 83/168 X |
| RE35,086 | E | * | 11/1995 | Paulson | 83/174 X |
| 5,522,292 | A | | 6/1996 | Biagiotti | |
| 5,557,997 | A | * | 9/1996 | Wunderlich et al. | 83/174 |
| 5,924,346 | A | * | 7/1999 | Wunderlich et al. | 83/174 X |

FOREIGN PATENT DOCUMENTS

| | | |
|---|---|---|
| EP | 0 677 360 A1 | 10/1995 |
| IT | 1 103 635 | 10/1985 |

* cited by examiner

*Primary Examiner*—Charles Goodman
(74) *Attorney, Agent, or Firm*—Breiner & Breiner, L.L.C.

(57) ABSTRACT

The severing machine comprises at least a first series of disk-shaped blades (23A; 23B) rotating about their own axis, which series is carried by a moveable support (21) capable of bringing the series of blades alternately into an active zone wherein the cutting of the products takes place and a parking zone. In addition, at least one barrier (41, 43) is provided separating the active zone from the parking zone.

16 Claims, 3 Drawing Sheets

SEVERING MACHINE FOR ARTICLES OF WEBLIKE MATERIAL HAVING A SHARPENING ZONE FOR THE BLADES SEPARATE FROM THE CUTTING ZONE

DESCRIPTION

1. Technical Field

The present invention relates to a severing machine for cutting rolls or logs of great length into a plurality of small rolls intended for final consumption, or for cutting other elongate products, especially of weblike material, for example packs of paper napkins or other interleaved articles.

Machines of this type are commonly used in the paper converting industry for the production of rolls of toilet paper, rolls of kitchen paper and the like, or other paper articles.

2. State of the Art

In the paper converting industry, and especially in the production of products comprising tissue paper, provision is commonly made for the weblike material to be wound up into logs or rolls of large axial dimensions and diameter equal to the diameter of the finished article. These logs or rolls are subsequently cut into a plurality of small rolls, of axial dimensions equal to the final dimension of the article intended for consumption, by means of severing machines.

Typically, in order to perform the cutting of the rolls, use is made of severing machines which possess an assembly rotating or oscillating about a shaft and on which are mounted one or more disk-shaped blades controlled in rotation about their respective axes. The movement of the assembly brings the disk-shaped blade(s) mounted thereon to penetrate cyclically into the material forming the roll, which is caused to advance below the rotating assembly. At each cycle of the rotating assembly, at least one small roll is cut from each of the rolls being fed. Normally, a plurality of rolls are caused to advance in parallel and are cut simultaneously with successive passages of the same disk-shaped blade carried by the rotating or oscillating assembly. When the assembly carries two blades, two cuts are made during each cycle.

An example of a severing machine of this type is described in U.S. Pat. No. 5,522,292.

According to another known technology, provision is made to cut each roll into the final number of small rolls in a single pass by means of a series of parallel cutting blades. A severing machine of this type is described in U.S. Pat. No. 4,329,895. In this machine, the rolls to be cut are inserted into cradles which advance in a linear manner below a plurality of parallel rectilinear blades inclined relative to the direction of advance of the rolls. The blades all penetrate together and gradually into the material of the roll, cutting the latter into a series of small rolls during a single pass.

Another example of a severing machine which allows the simultaneous cutting of each roll into a plurality of small rolls is described in IT-B-1 103 635. In this known machine, a rotating assembly presents the individual rolls, which are accommodated in respective seatings, to a set of rotating blades. The rotating blades have a shape such as to penetrate gradually with their cutting edges into the thickness of the rolls.

Both the multiple cutting machines currently known and the machines that use blades equipped with a planetary motion to "slice" the rolls fail to meet the current safety standards. Furthermore, the multiple severing machines currently known suffer from problems with sharpening the blades.

OBJECTS AND SUMMARY OF THE INVENTION

It is an object of the present invention to provide a multiple severing machine, in other words a machine equipped with a plurality of cutting blades for simultaneously cutting a plurality of small rolls from a roll or log fed to the machine, or for cutting other elongate products into series of articles of lesser length, which is safer than the traditional machines and can permit a reduction in the contamination of the cut article.

This and other objects and advantages, which will become apparent to the persons skilled in the art from reading the text that follows, are achieved by a severing machine comprising at least one series of disk-shaped blades rotating about their own axes of rotation, in which the series of blades is carried by a moveable support capable of displacing said series of blades alternately into an active or cutting zone and into a parking zone, and in which a barrier is provided separating the active or cutting zone from the parking zone in which sharpening of the blades may be carried out, so that the dust and other contaminants deriving from the sharpening are retained in the parking zone and their penetration into the active zone is impeded.

In what follows, the active zone will be designated the cutting zone and the parking zone as the sharpening zone, although other operations may also be carried out therein (as will be clarified below).

The barrier which separates the sharpening zone from the cutting zone also serves to prevent the sparks generated during sharpening from being able to trigger dangerous fires on reaching the weblike material of which the rolls being cut are formed. This risk is particularly high in the traditional machines where the sharpening zone is situated directly above the cutting zone and is in no way separated therefrom. The risk of fire is particularly great by reason of the presence of dusts of paper or other highly flammable material from which the rolls are formed, which dusts are formed during cutting and may be impregnated with lubricant. With the barrier provided by the present invention, the flammable dusts are kept separate from the sharpening zone (where sparks are generated) and the operating safety is thus increased. A further technical safety advantage is represented by the possibility of maintenance work being carried out in the parking zone, cut off—by the barrier—from the cutting zone.

According to an advantageous embodiment of the invention, the support on which the cutting blades are mounted has an elongate development in the form of a beam along an axis of oscillation or rotation. The support can rotate or oscillate about this axis in order to move the series of blades from the sharpening zone to the cutting zone and vice versa.

In order to achieve high production speeds, and also to balance the mechanical structure of the machine, according to a particularly advantageous embodiment of the invention, a second series of disk-shaped cutting blades is provided, arranged on the support, in a manner such that when one of the two series of blades is in the cutting zone the other is in the sharpening zone and vice versa.

The possibility is not ruled out that more than two groups or series of cutting blades are arranged on the same support. The use of at least two series of cutting blades makes it possible to carry out the sharpening operation or other auxiliary operations during the cutting operations. Furthermore, it is possible to provide for the various series of disk-shaped cutting blades to be arranged at different intervals, so as to enable articles of different axial dimensions to be produced with the same severing machine without intermediate setting operations.

The use of two or more groups or series of blades can allow the rapid replacement of an entire group with another group when the former is in non-operating conditions, for example when the blades are worn.

In order to separate the sharpening zone from the cutting zone, barriers of various types may be provided, for example flexible, sliding or other barriers. According to a particularly advantageous embodiment of the invention, however, the barrier comprises two walls oscillating about axes parallel to the axis of oscillation or rotation of the support on which the one or more series of blades is or are mounted. The two oscillating walls interact with the support to form a separation barrier between the cutting zone and the sharpening zone, bearing, with the edges opposite the axis of oscillation, on the support bearing the cutting blades.

In the zone isolated by the barrier, devices for washing the sharpened blades may be provided in order to remove all of the sharpening dusts. Where there are three or more groups of blades, the washing devices may be arranged in a station separate from the sharpening station and possibly isolated therefrom by means of a further barrier.

Further advantageous features of the severing machine according to the invention are indicated in the attached claims and will be described in detail with reference to examples of embodiment.

BRIEF DESCRIPTION OF THE DRAWINGS

The invention will be better understood with reference to the description and the attached drawing, which shows a practical, non-limiting embodiment of said invention applied to a severing machine for rolls, which cuts the rolls into small rolls of shorter length. In the drawing.

DETAILED DESCRIPTION OF THE PREFERRED EMBODIMENTS OF THE INVENTION

Figure 1:
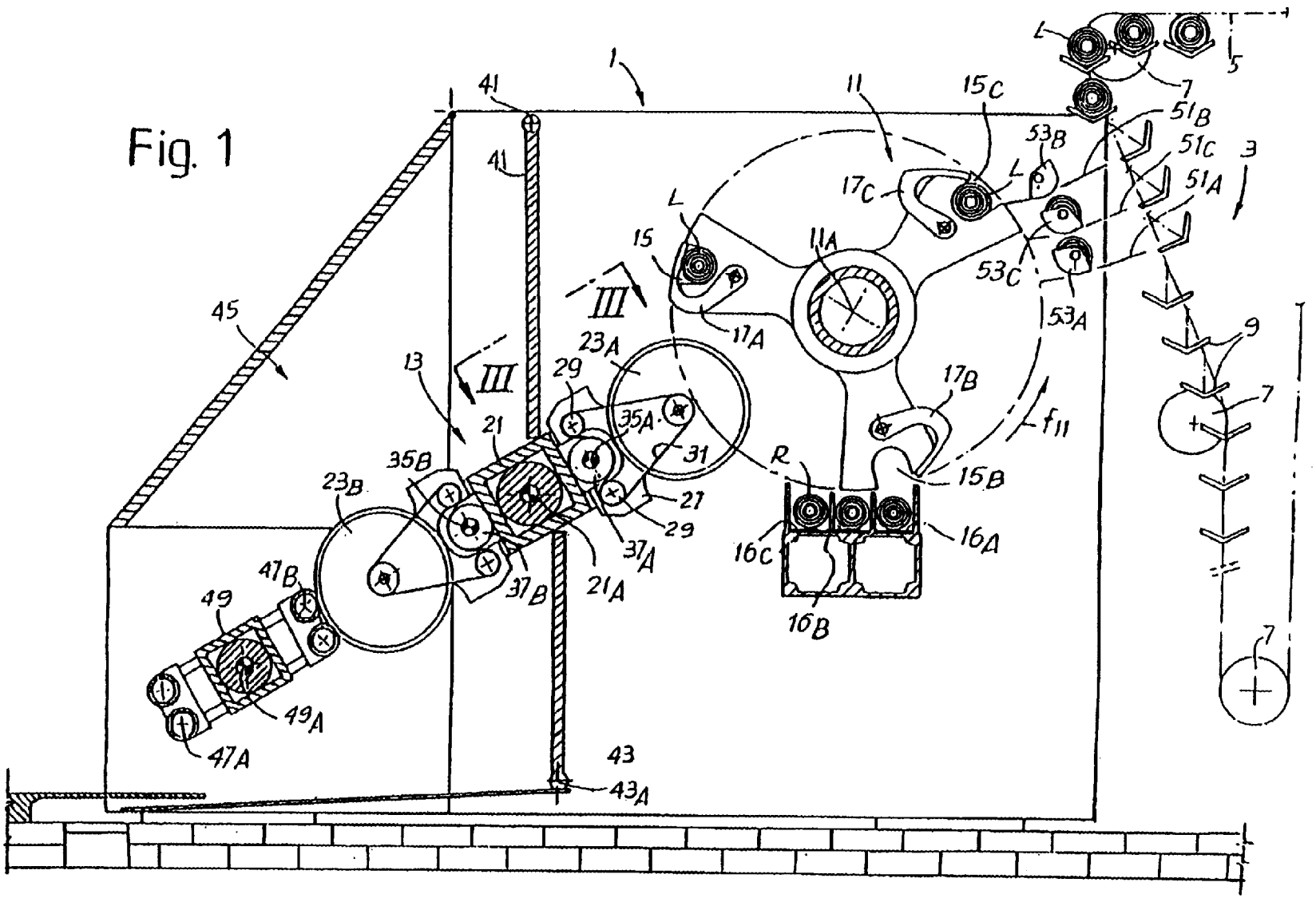
FIG. 1 shows a diagrammatic lateral view of the severing machine under working conditions.

The severing machine, generally designated 1, is fed with series of rolls or logs L by a storage unit 3 arranged on one side of the machine. The storage unit 3 comprises a flexible member 5 passed around a series of pulleys 7 and bears a plurality of oscillating cradles 9, which unload the logs L to loading positions in the severing machine, in a manner that will be described below. The storage unit 3 is of a type known per se and will not be described in more detail. It may be replaced by any other system for feeding the logs to be cut.

The severing machine 1 has a rotating feeder 11 which takes the incoming rolls L and presents them to a cutting unit 13. In the example shown, the rotating feeder 11 is constituted by an assembly rotating about a horizontal shaft 11A and is equipped with three seatings 15A, 15B and 15C, arranged at steps of 120° relative to one another about the axis of rotation 11A. Associated with each seating 15A, 15B, 15C is a respective retaining member 17A, 17B and 17C. The retaining members 17A, 17B and 17C serve to secure the logs or rolls L in the respective seatings 15A, 15B, 15C during cutting, in a manner which will be described below. The configuration of the rotating feeder may be different from that illustrated, and this member may also be replaced by another system for feeding the rolls to the rotating disk-shaped cutting blades.

Below the rotating feeder 11 are arranged, in the example shown, three unloading channels designated 16A, 16B and 16C respectively. Within each unloading channel is arranged a conveyor belt or other means for removing the small rolls, which moves in the direction orthogonal to the plane of the drawing in FIGS. 1 and 2.

The cutting unit 13 comprises a support 21 formed by a horizontal beam rotating or oscillating about a horizontal axis 21A. The support 21 bears two series of rotating disk-shaped cutting blades, designated 23A and 23B. The two series of disk-shaped blades 23A and 23B are mounted symmetrically on the support 21 and only one of them will be described in detail with reference, in particular, to FIG. 3. The blades of each series rotate about a respective common axis of rotation. It must be understood, however, that the axes of the blades of each series may also be slightly staggered and/or may have slightly different orientations, in other words not be parallel.

The rotating disk-shaped blades 23A are mounted in pairs (FIG. 3), each pair being supported by a spindle 25 mounted on a respective bracket 27. Mounted on the bracket 27 are two toothed drive pulleys 29 for a toothed belt 31, which is in turn driven about a third toothed pulley 33 made integrally on a support of one of the blades 23A of each pair, torsionally linked to the shaft 25. For each series of disk-shaped blades 23A, 23B, a common driveshaft 35A, 35B is mounted on the support 21, on which driveshaft drive pulleys 37A, 37B are splined which supply the motion to the toothed belt 31 of each pair of blades 23A, 23B. A preferably dual motor drive, or one having suitable clutches (not shown), causes the two driveshafts 35A and 35B to rotate independently of one another.

Figure 3:
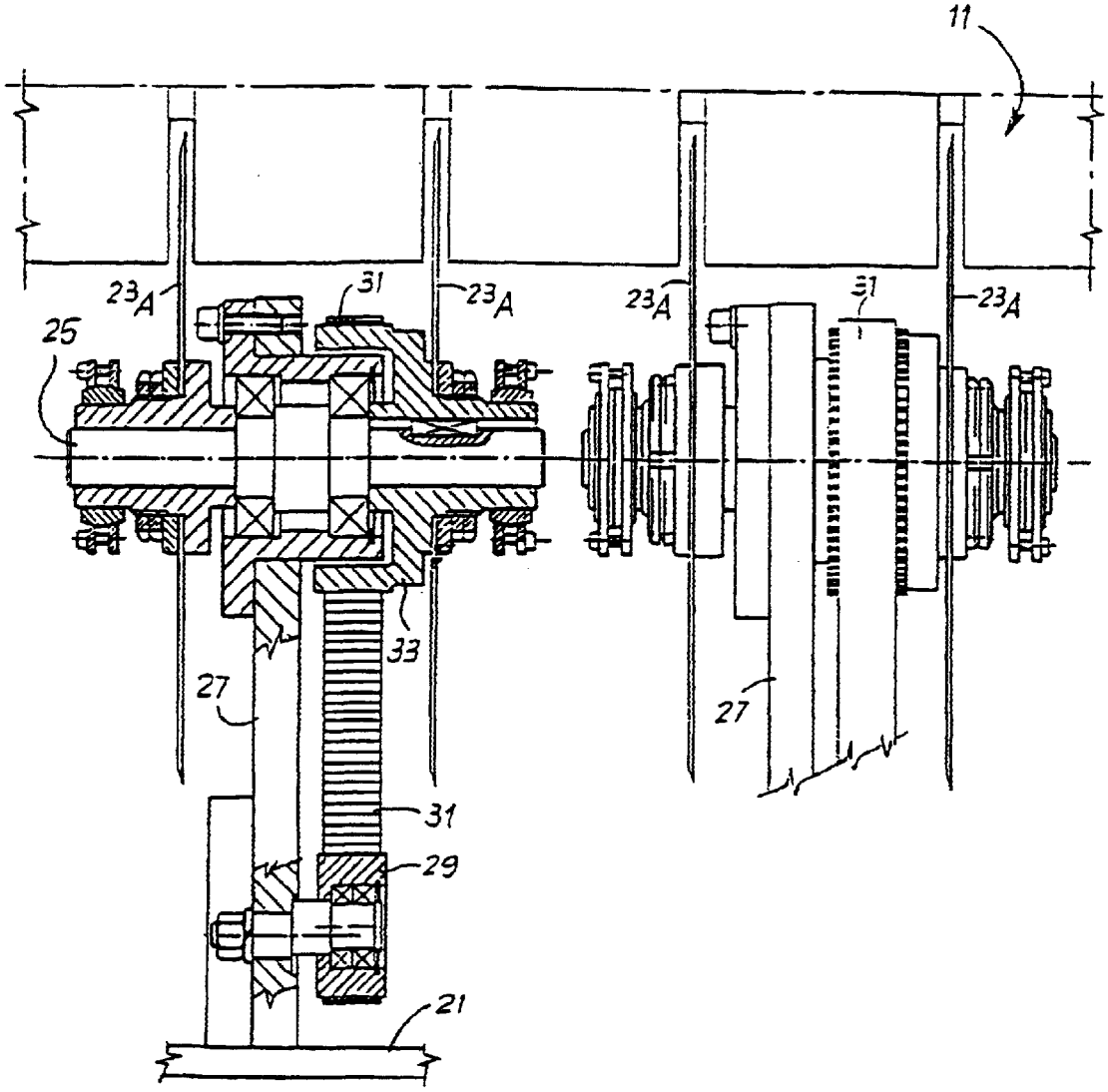
FIG. 3 shows a lateral view along the line 111—111 in FIG. 1.

As can be seen in FIGS. 1 and 3, the blades 25A, 25B and the respective belts 31 are mounted on the bracket 27, and the latter is mounted relative to the support 21 and to the pulleys 37A, 37B in a manner such that each pair of blades and associated supports may be easily removed and refitted without the need to remove and refit the belts 31.

Two walls 41, 43 interact with the support 21 and oscillate about horizontal axes 41A and 43A, parallel to the axis 21A of rotation or oscillation of the support 21. The walls 41 and 43 may assume the position shown in FIG. 1, in which, together with the support 21, they define a barrier which separates the cutting zone, where the cutting of the rolls or logs L into small rolls takes place, from the sharpening zone, generally designated 45. In the latter, other operations may also be performed, for example those of maintaining and/or washing the blades.

In the sharpening zone 45 are located a first sharpening group 47A and a second sharpening group 47B. The two sharpening groups 47A and 47B are each formed by pairs of sharpening wheels, each associated with one of the rotating disk-shaped blades 23A, 23B of the two series of disk-shaped blades. The two sharpening groups 47A and 47B are carried by a common rotating or oscillating assembly 49 mounted about a horizontal axis 49A, parallel to the axis 21A of the support 21 of the series of disk-shaped cutting blades 23A and 23B. The positions of the wheels of the two groups 47A and 47B can be independently adjusted and each group follows the wear of the blade of the respective series. The regulation of the position and the recovery of wear take place in a manner known per se.

The machine described hitherto operates as follows.

The rolls or logs L are unloaded in alternation onto three unloading chutes 51A, 51B and 51C, with each of which is associated a rotating distributor 53A, 53B and 53C respectively. The rotating feeder 11 sequentially removes a log or roll L from one or other of the loading positions defined by the chutes 51A, 51B and 51C and by the distributors 53A, 53B and 53C, in a manner and for the purposes which will be described in greater detail below.

Each roll L is received in one of the seatings 15A, 15B and 15C of the rotating feeder 11 and secured there by means of the respective retaining members 17A, 17B or 17C. By means of a counterclockwise rotation in the direction of the arrow f11, the rotating feeder 11 carries each roll L in front of the cutting unit 13. As can be seen in FIG. 1, the position of the seatings 15A, 15B and 15C relative to the disk-shaped blades 23A (or alternatively 23B) is such as to ensure that the latter penetrate gradually, with the rotation of the rotating feeder 11, into the wound-up weblike material which forms the roll L. For this purpose, the seatings 15A, 15B and 15C have appropriate cuts which allow the passage of the disk-shaped cutting blades 23A and 23B (FIG. 3). Similarly, the retaining members 17A, 17B, 17C are spaced so as not to interfere with the rotating disk-shaped blades 23A, 23B.

The disk-shaped blades 23A or 23B are arranged in a number and position such as simultaneously to cut a roll L into the desired final number of small rolls, and further to cut two trims, head and tail, which are scrapped in a manner known per se.

The two series of rotating disk-shaped blades 23A and 23B operate in alternation. In the configuration shown in FIG. 1, the series of disk-shaped blades 23A is in operation, while the series of blades 23B is located in the sharpening zone 45 and is being subjected to sharpening by means of the sharpening group 47B.

Figure 2:
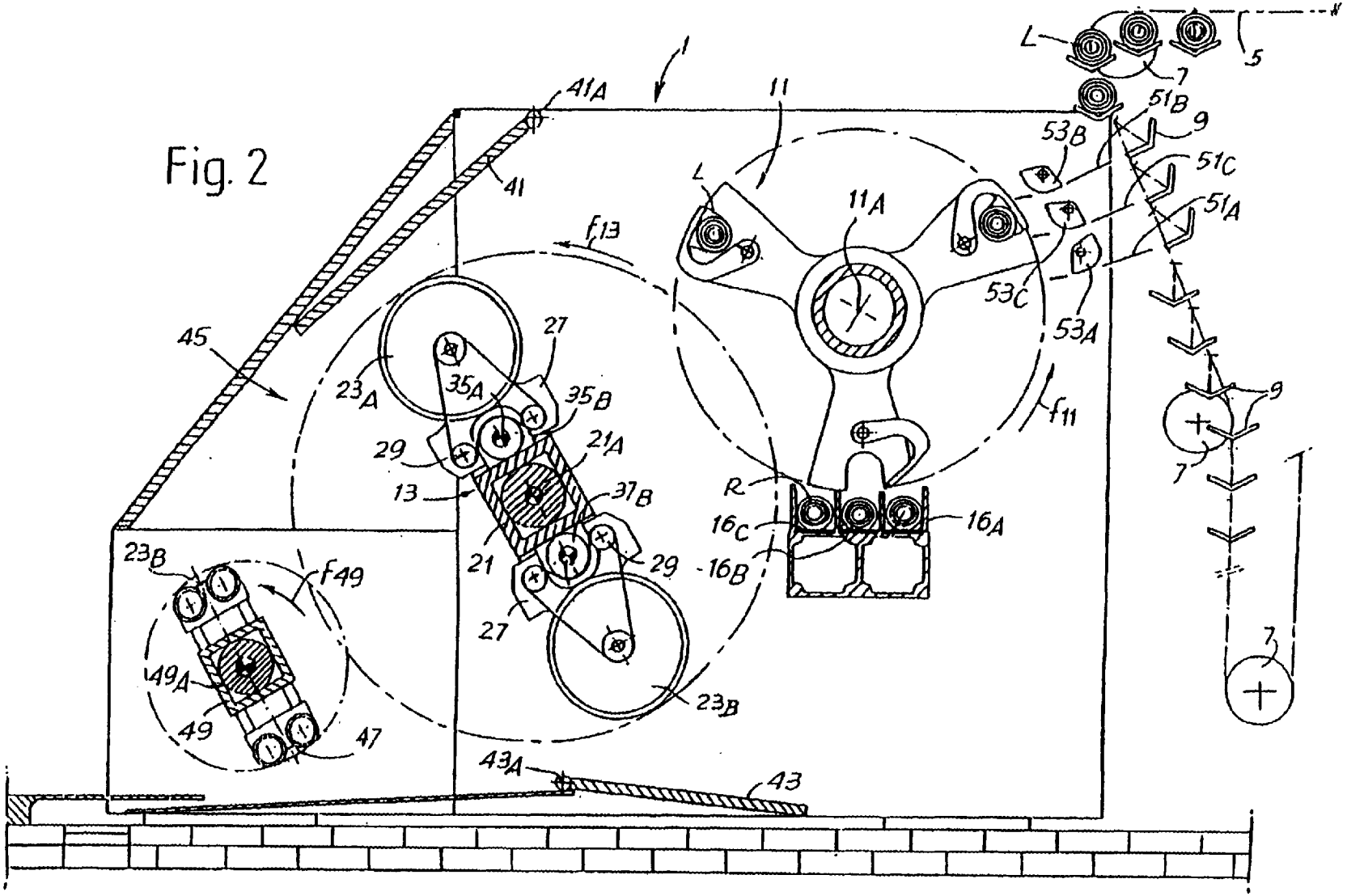
FIG. 2 shows, in a lateral view, an intermediate phase of cutting blade exchange.

When it is necessary to discontinue operation with the disk-shaped blades of series 23A and initiate operation with the series of disk-shaped blades 23B, the two walls 41A and 41B are opened and the support 21 is rotated through 180° . FIG. 2 shows an intermediate phase of the movement by which the series of blades 23A and 23B exchange position.

During this exchange operation, the support assembly 49 also rotates, so that when the blades 23A arrive in the sharpening zone 45, the sharpening wheels 47A interact therewith.

With this method of operation, it is possible to carry out the sharpening of the blades in a zone which is completely isolated from the cutting zone and over a period that may be protracted insofar as it is in any case in the background relative to the cutting operations which are being performed by the blades currently in operation.

Since the series of blades 23A and 23B may have undergone different degrees of wear, the use of independent sharpening groups 47A and 47B for the two series of disk-shaped blades 23A and 23B makes it possible to relocate, during each sharpening cycle, the exact relative position between sharpening wheels and associated disk-shaped cutting blades.

It is understood that the drawing shows only a simplification, provided solely by way of a practical demonstration of the invention, the latter being capable of being varied in shapes and arrangements without thereby departing from the scope of the idea underlying said invention.

What is claimed is:

1. A severing machine for cutting an elongate product into a plurality of articles, comprising at least a first series of disk-shaped blades rotating about their own axis, wherein said first series of blades is carried by a moveable support capable of bringing said first series of blades alternately into an active zone wherein the cutting of the articles takes place and into a parking zone, and wherein at least one barrier is provided separating the active zone from the parking zone.

2. Severing machine as claimed in claim 1, wherein at least one sharpening unit is arranged in said parking zone.

3. Severing machine as claimed in claim 1, wherein a system for washing the blades is arranged in said parking zone.

4. Severing machine as claimed in claim 2, wherein a system for washing the blades is arranged in said parking zone.

5. Severing machine as claimed in claim 1, wherein said support has an elongate development along an axis and is oscillating or rotating about said axis in order to move said first series of blades between the parking zone and the active zone and vice versa.

6. Severing machine as claimed in claim 2, wherein said support has an elongate development along an axis and is oscillating or rotating about said axis in order to move said first series of blades between the parking zone and the active zone and vice versa.

7. Severing machine as claimed in claim 3, wherein said support has an elongate development along an axis and is oscillating or rotating about said axis in order to move said first series of blades between the parking zone and the active zone and vice versa.

8. Severing machine as claimed in claim 1, 2, 3, 4, 5, 6 or 7, wherein at least a second series of blades is provided on said support, said first and said second series of blades being arranged on said support in a manner such that, when the first series of blades is in the active zone, the second series of blades is in the parking zone and vice versa.

9. Severing machine as claimed in claim 8, wherein said barrier comprises two walls oscillating about axes parallel to the axis of oscillation or rotation of said support, which interact with said support to separate the active zone from the parking zone, and are arranged on opposite sides relative to said support.

10. Severing machine as claimed in claim 8, wherein a first sharpening unit associated with said first series of blades and a second sharpening unit associated with said series of blades are arranged in said parking zone.

11. Severing machine as claimed in claim 10, wherein said two sharpening units are carried by a common support apparatus which alternatively moves one of said sharpening units into a working position and the other sharpening unit into a waiting position.

12. Severing machine as claimed in claim 11, wherein said support apparatus is developed along an axis of rotation or oscillation.

13. Severing machine as claimed in claim 1, 2, 3, 4, 5, 6 or 7, comprising a rotating feeder for removing the products to be cut and presenting them to the disk-shaped blades, which has at least one seating for said products to be cut and a retaining member which holds the product to be cut in said seating during cutting.

14. Severing machine as claimed in claim 13, wherein said rotating feeder comprises a plurality of seatings for said products to be cut and is controlled in a manner such as to position each of said seatings in sequence, with a respective product contained therein, in the active zone.

15. Severing machine as claimed in claim 1, 2, 3, 4, 5, 6 or 7, wherein brackets are provided on said support, each carrying a small shaft on which are mounted two disk-shaped blades, a flexible transmission member being provided in order to transmit the motion from a common drive shaft, parallel to said support, to said small shafts.

16. Severing machine as claimed in claim 15, wherein said brackets carry two return pulleys for said flexible transmission member, which is further passed around a pulley keyed on said small shaft, the flexible member being passed around a drive pulley, in the section comprised between the two pulleys carried by the brackets.

* * * * *